US005480577A

United States Patent [19]

Nicholson et al.

[11] Patent Number: 5,480,577

[45] **Date of Patent: *Jan. 2, 1996**

[54] ENCAPSULATES CONTAINING SURFACTANT FOR IMPROVED RELEASE AND DISSOLUTION RATES

[75] Inventors: John R. Nicholson, Ramsey, N.J.; David J. Lang, Ossining, N.Y.

[73] Assignee: Lever Brothers Company, division of Conopco, Inc., New York, N.Y.

[ * ] Notice: The term of this patent shall not extend beyond the expiration date of Pat. No. 5,230,822.

[21] Appl. No.: 255,146

[22] Filed: Jun. 7, 1994

[51] Int. Cl.[6] ..... C11D 1/00

[52] U.S. Cl. ..... 252/174.13; 252/95; 252/186.25; 252/186.26; 252/186.27

[58] Field of Search ..... 252/95, 174.13, 252/186.25, 186.26, 186.27

[56] References Cited

U.S. PATENT DOCUMENTS

| | | | |
|---|---|---|---|
| 4,919,841 | 4/1990 | Kamel et al. | 252/186.26 |
| 5,200,236 | 4/1993 | Lang et al. | 427/213 |
| 5,230,822 | 7/1993 | Kamel et al. | 252/174.13 |
| 5,258,132 | 11/1993 | Kamel et al. | 252/94 |
| 5,281,355 | 1/1994 | Tsaur et al. | 252/174.13 |

*Primary Examiner*—Christine Skane
*Assistant Examiner*—Gregory R. Delcotto
*Attorney, Agent, or Firm*—A. Kate Kuffman

[57] ABSTRACT

Wax-encapsulated particles having a core particle or an aggregate of core particles selected from the group of an organic peroxy acid, a diacyl peroxide, an inorganic peroxygen compound, a bleach catalyst, a peroxygen bleach precursor and mixtures thereof together with 0.01% to about 5% by weight of a surfactant. The resulting particles exhibit release rates from their capsules and dissolution rates comparable to uncoated core materials.

14 Claims, No Drawings

ENCAPSULATES CONTAINING SURFACTANT FOR IMPROVED RELEASE AND DISSOLUTION RATES

FIELD OF THE INVENTION

The invention relates to encapsulates which incorporate a surfactant with an active core for improved release rates of the active from the particles and improved dissolution rates in a washing cycle.

BACKGROUND OF THE INVENTION

Oxygen bleaching agents have become an important alternative to chlorine or bromine bleaching agents in automatic dishwashing formulations. However, many oxygen bleaches are insufficiently stable to be incorporated in surfactant containing detergent solutions. One solution to the instability problem is to encapsulate the agent.

Paraffin wax has been successfully used to encapsulate solid core materials which are unstable in humid or liquid environments (See Lang et al. U.S. Pat. No. 5,200,236 and Kamel et al. U.S. Pat. No. 5,258,132.). The paraffin wax coatings require a specific melting point range and solids content so that the particles sufficiently melt within the washing cycle of an automatic dishwasher to provide effective cleaning without leaving a waxy residue upon cleaned dishware surfaces.

For effective release of the bleach in the wash, it is critical that the oxygen agent has a rapid dissolution rate. It has been observed that oxygen agents, such as phthalimidoperhexanoic acid (PAP), encapsulated in a paraffin wax coating have a dissolution rate slower than useful for incorporation in detergent compositions. The coating material dissolves at washing temperatures but has a tendency to stick to the active core material to inhibit its dissolution rate.

SUMMARY OF THE INVENTION

It is thus an object of the invention to provide active cores encapsulated in a paraffin wax coating which are rapidly released from their molten coatings.

Another object of the invention is to incorporate a surfactant with the core to improve the release rate of the cores from the encapsulates.

A further object of the invention is to provide a viable method of wax encapsulating the oxygen bleaching agents to provide stable yet rapid dissolving granules with minimal attrition.

In the first aspect, the invention provides an active core which constitutes from 10–80% by weight, preferably from 45–60% by weight and more preferably 50–60% by weight of the final particles (i.e., core plus coating). The core includes components which are unstable in a liquid environment such as oxygen bleaching agents, enzymes, peracid precursors, bleach catalysts, surfactants, etc. Oxygen bleaching agents include organic peroxy acids and diacyl peroxides which are substantially stable in a temperature range of about 40° C. to about 50° C.

The core is combined with 0.01% to about 5% by weight of a surfactant which may be anionic, cationic, zwitterionic or nonionic. Preferred surfactants are anionics such as sulfonates or sulphates. Specific examples of suitable anionic surfactants include secondary sodium n-alkane sulphonates, preferably with chain lengths of 13 to 17 carbon atoms, sodium lauryl sulphate, potassium dodecyl sulphonate, sodium dodecyl benzene sulphonate, sodium salt of lauryl polyoxyethylene sulphate, lauryl polyethylene oxide sulfonate, dioctyl ester of sodium sulphosuccinic acid and sodium lauryl sulphonate.

The peroxygen compound and surfactant mixture is comprised of one or more paraffin waxes which comprises 20–90% by weight, preferably 40–60% by weight, most preferably 40–50% by weight of the particle. The paraffin coating has a melting point of from about 40° C. to about 50° C. and a solids content of from about 35% to 100% at 40° C. and from 0% to about 15% at 50° C. The paraffin coating may be combined with a polyvinyl ether material in a ratio of from about 70%:30% to 1%:99% of the polyvinyl ether material to the paraffin wax as described in copending application U.S. Ser. No. 08/239,663, Delwel et al., filed on May 9, 1994.

In a second aspect, the invention comprises a process of making the encapsulated particles. The core material is agglomerated, if necessary, and coated with the coating material to form a continuous coherent coating having a thickness of from about 100 microns to 1500 microns. Preferred processing methods include the use of a fluidized bed operation or a high-speed rotating pan coating.

A third aspect of the invention comprises liquid cleaning compositions which include 0.1% to 20% by weight of the active core and surfactant encapsulates, 0.1% to 70% by weight of a builder, 0.1% to 30% by weight of an alkalinity agent and other conventional cleaning components.

DETAILED DESCRIPTION OF PREFERRED EMBODIMENTS

The encapsulates of the invention combine an active core and a surfactant to improve release and dissolution rates of the actives from the coatings. The paraffin coating becomes molten at least about 40° C. to about 50° C. and releases the active. The release rate is significantly improved by combining the active core with a selected surfactant. Without being limited by theory, it is believed that the surfactant assists in dispersing the molten coating which has a tendency to stick to the active core and inhibit its release. The presence of the surfactant in the encapsulates also improves the dissolution rate of the active core to a rate comparable to the rate of uncoated core materials.

The term "solid core" materials used in cleaning products which may be encapsulated in the invention means those components which are unstable in the presence of a bleaching agent in liquid or humid environments or a bleaching agent which is unstable in an aqueous environment, in particular in an alkaline aqueous environment. All of these materials will lose activity without a paraffin wax coating according to the invention. Core materials within the scope of the invention include non-friable solid materials which are water soluble or water dispersible or which dissolve, disperse or melt in the temperature range of 40° C.–50° C. Such core materials include bleach, enzymes, peracid precursors, bleach catalysts, surfactants and perfumes.

The encapsulated core particle of the invention normally comprises 20% to 90% by weight of a single coat of paraffin wax and 10% to 80% by weight of a solid core material suitable for use in household and industrial strength cleaning compositions. Preferably the paraffin wax coating comprises 40% to 60% by weight of the particle. Most preferably the coating comprises 40% to 50% by weight of the particle core and the core 50% to 60% by weight of the particle.

In the preferred embodiment, the shape of the core is spherical or as close to this geometry as possible. It is further preferred to have a core particle size of 100–2,500 microns and more preferably from 500–1,500 microns in diameter.

Peroxygen Compound

Organic peroxy acids and diacyl peroxides may be utilized as the bleach core. The peroxy acids usable in the present invention are solid compounds and substantially stable in the temperature range of about 40° to about 50°.

Typical monoperoxy acids useful herein include alkyl peroxy acids and aryl peroxy acids such as:

(i) peroxybenzoic acid and ring-substituted peroxybenzoic acids, e.g., peroxy-alpha-naphthoic acid, and magnesium monoperphthalate (ii) aliphatic and substituted aliphatic monoperoxy acids, e.g., peroxylauric acid, peroxystearic acid, phthalimidoperoxyhexanoic acid, and o-carboxybenzamido peroxyhexanoic acid.

A preferred monoperoxy acid is phthalimidoperoxyhexanoic acid.

Typical diperoxy acids useful herein include alkyl diperoxy acids and aryldiperoxy acids, such as:

(iii) 1,12-diperoxydodecanedioic acid (iv) 1,9-diperoxyazelaic acid (v) diperoxybrassylic acid; diperoxysebacic acid and diperoxyisophthalic acid (vi) 2-decyldiperoxybutane-1,4-dioic acid.

(vii) N-nonenylamidoperadipic acid and N-nonenylamidopersuccinic acid (viii) N,N'-terephthaloyl-di-6-aminoperoxy caproic acid A typical diacylperoxide useful herein includes dibenzoylperoxide.

Inorganic peroxygen compounds may also be suitable as cores for the particles of the present invention. Examples of these materials are salts of monopersulfate, perborate monohydrate, perborate tetrahydrate, and percarbonate.

Bleach Catalyst

Bleach catalysts are also suitable as the core material of the present invention. Such suitable catalysts include a manganese (II) salt compound as described in U.S. Pat. No. 4,711,748. Other suitable catalysts are described in U.S. Pat. No. 5,041,232 issued to Batal et al., e.g., sulfonimine compounds, herein incorporated by reference. The catalysts may be admixed with, or adsorbed upon other compatible ingredients. Product formulations containing encapsulated bleach catalysts of the present invention may also contain a bleaching agent whose action is to be catalyzed. The bleaching agent may also be optionally encapsulated according to the present invention.

Peroxygen Bleach Precursors

Peracid precursors, preferably in granular form of size from 100 to 2,500 microns, preferably 500 to 1,500 microns are also suitable as cores for the particles of the present invention. Peracid precursors are compounds which react in the bleaching solution with hydrogen peroxide from an inorganic peroxygen source to generate an organic peroxy acid. They are also susceptible to hydrolysis, and cannot normally be formulated directly into aqueous cleaning compositions. Peracid precursors, encapsulated according to the present invention, would be incorporated into products along with a source of hydrogen peroxide, which also could optionally be encapsulated according to the present invention.

Peracid precursors for peroxy bleach compounds have been amply described in the literature, including in British Nos. 836,988; 855,735; 907,356; 907,358; 907,950; 1,003,310 and 1,246,339; U.S. Pat. Nos. 3,332,882 and 4,128,494; Canadian No. 844,481 and South African No. 68/6,344.

Typical examples of precursors are polyacylated alkylene diamines, such as N, N, N', N'-tetraacetylethylene diamine (TAED) and N, N, N', N'-tetraacetylmethylene diamine (TAMD); acylated glycolurils, such as tetraacetylglycoluril (TAGU); triacetylcyanurate, sodium sulphophenyl ethyl carbonic acid ester, sodium acetyloxybenzene sulfonate (SABS), sodium nonanoyloxybenzene sulfonate (SNOBS) and choline sulfophenyl carbonate.

Peroxybenzoic acid precursors are known in the art, e.g., from GB-A-836988. Examples thereof are phenylbenzoate; phenyl p-nitrobenzoate; o-nitrophenyl benzoate; o-carboxyphenyl benzoate; p-bromophenyl benzoate; sodium or potassium benzoyloxybenzenesulfonate; and benzoic anhydride.

Preferred peroxygen bleach precursors are sodium p-benzoyloxybenzene sulfonate, N, N, N', N'- tetracecetylethylene diamine, sodium nonanoyloxybenzene sulfonate and choline sulfophenyl carbonate.

Surfactant Incorporated in Encapsulates

Surfactants useful in the invention are those which are stable at from about 40° C. to about 50° C. Examples of suitable surfactants include anionic, nonionic, cationic or zwitterionic types, preferably in solid form for processing and stability of capsules.

The surfactant is incorporated in the encapsulates as described below in an amount of from 0.01% to about 5% by weight, preferably 0.05% to about 2% by weight, most preferably 0.1% to 1% by weight of the encapsulate (i.e., percentages based on core and about 50% coating).

As explained, the surfactants usable in the present invention can be anionic, nonionic, cationic or zwitterionic in nature or soap as well as mixtures of these. Preferred surfactants are the anionics, the nonionics and/or soap.

The anionics comprise the well-known anionic surfactant of the alkyl aryl sulphonate type, the alkyl sulphate and alkyl ether sulphate and sulphonate types, the alkane and alkene sulphonate type, etc. In these surfactants the alkyl radicals may contain from 9–20 carbon atoms. Numerous examples of such materials and other types of surfactants can be found in Schwartz, Perry, Vol. II, 1958, "Detergents and Surface Active Agents".

Especially useful anionic surfactants include secondary sodium n-alkane sulphonates preferably with chain lengths of 13 to 17 carbon atoms, sodium lauryl sulphate, potassium dodecyl sulphonate, sodium dodecyl benzene sulphonate, sodium salt of lauryl polyoxyethylene sulphate, lauryl polyethylene oxide sulfonate, dioctyl ester of sodium sulphosuccinic acid and sodium lauryl sulphonate. Sulphonates are especially preferred.

The nonionics comprise ethylene oxide and/or propylene oxide condensation products with alcohols, alkylphenol, fatty acids, fatty acid amides. These products generally can contain from 5 to 30 ethylene oxide and/or propylene oxide groups. Fatty acid mono-and dialkylolamides, as well as tertiary amine oxides are also included in the terminology of nonionic detergent-active materials.

Specific examples of nonionic surfactants include nonyl phenol polyoxyethylene ether, tridecyl alcohol polyoxyethylene ether, dodecyl mercaptan polyoxyethylene thioether, the lauric ester of polyethylene glycol, $C_{12}$–$C_{15}$ primary alcohol/7 ethylene oxides, the lauric ester of sorbitan polyoxyethylene ether, tertiary alkyl amine oxide and mixtures thereof.

Other examples of nonionic surfactants can be found in Schwartz, Perry, Vol. II, 1958, "Detergents and Surface Active Agents" and Schick, Vol. I, 1967, "Nonionic Surfactants".

The cationic surfactants which can be used in the present invention include quaternary ammonium salts which contain at least one alkyl group having from 12 to 20 carbon atoms. Although the halide ions are the preferred anions, other suitable anions include acetate, phosphate, sulphate, nitrite and the like.

Specific cationic surfactants include distearyl dimethyl ammonium chloride, stearyl dimethyl benzyl ammonium chloride, stearyl trimethyl ammonium chloride, coco dimethyl benzyl ammonium chloride, dicoco dimethyl ammonium chloride, cetyl pyridinium chloride, cetyl trimethyl ammonium bromide, stearyl amine salts that are soluble in water such as stearyl amine acetate and stearyl amine hydrochloride, stearyl dimethyl amine hydrochloride, distearyl amine hydrochloride, alklyl phenoxyethoxyethyl dimethyl ammonium chloride, decyl pyridinium bromide, pyridinium chloride derivative of the acetyl amino ethyl esters of lauric acid, lauryl trimethyl ammonium chloride, decyl amine acetate, lauryl dimethyl ethyl ammonium chloride, the lactic acid and citric acid and other acid salts of stearyl-1-amidoimidazoline with methyl chloride, benzyl chloride, chloroacetic acid and similar compounds, mixtures of the foregoing and the like.

Zwitterionic surfactants include alkyl-β-iminodipropionate, alkyl-β-aminopropionate, fatty imidazolines, betaines, and mixtures thereof.

Specific examples of such detergents are 1-coco-5-hydroxyethyl-5-carboxymethyl imidazolline, dodecyl-β-alanine, the inner salt of 2-trimethylamino lauric acid and N-dodecyl-N, N-dimethyl amino acetic acid.

Coating Material

The coating of the encapsulate must exhibit a melting point of between about 40° C. and about 50° C. and a solids content of from about 35% to 100% at 40° C. and a solids content of 0% to about 15% at 50° C. and a viscosity of less than 200 centipoises at 80° C. Especially useful as the coating material are the paraffin waxes such as those described in Lang et al. U.S. Pat. No. 5,200,236, herein incorporated by reference.

The amount of solids in a wax at any given temperature as well as the melting point range may be determined by measuring the latent heat of fusion of each wax by using differential scanning calorimetry (DSC) by a process described in Miller, W. J. et al., Journal of American Oil Chemists Society, July 1969, vol. 46, no. 7, pages 341–343, herein incorporated by reference. DSC equipment used in the procedure is preferably the Perkin Elmer Thermoanalysis System 7 or the DuPont Instrument DSC 2910.

The paraffin wax may be combined with from about 70% to about 1% of a polyvinyl ether material having a formula $$[C_xH_{2x}O]y \quad (I)$$

wherein x is an integer from 18–22 and y is an integer from 150–300. The polyvinyl ether alters the paraffin wax to produce coatings having an improved compressibility and flowability which is also useful for the invention. Such coatings are described in copending application U.S. Ser. No. 08/239,663 filed on May 9, 1994 by Delwel et al., herein incorporated by reference.

Commercially available paraffin waxes which are suitable for the invention include Merck 7150® (54% solids content at 40° C. and 0% solids content at 50° C.) and Merck 7151® (71% solids content at 40° C. and 2% solids content at 50° C.) ex E. Merck of Darmstadt, Germany; Boler 1397® (74% solids content at 40° C. and 0% solids content at 50° C.), Boler 1538® (79% solids content at 40° C. and 0.1% solids content at 50° C.) Boler 1072®( 100% solids content at 40° C. and 71.4% solids content at 50° C.) ex Boler of Wayne, Pennsylvania; Ross fully refined paraffin wax 115/120 (36% solids content at 40° C. and 0% solids content at 50° C.) ex Frank D. Ross Co., Inc. of Jersey City, N.J.; Paramelt 4608®(80.3% at 40° C. and 0% at 50° C. solids content with a melting point of 44° C.) ex Terhell Paraffin of Hamburg, Germany and Paraffin R7214® ex Moore & Munger of Shelton, Conn.

The Process of Encapsulating Solid Core Particles

The process steps of encapsulating the solid core particles comprise:

(a) selecting a core material and a surfactant to be encapsulated together, (b) agglomerating the selected core material to form a particle having a diameter of 100 to 2,500 microns, (c) mobilizing the particles, (d) selecting a paraffin wax to form a coating having a melting point range of about 40° C. to about 50° C., a solids content of from about 35% to 100% at 40° C., from 0% to about 15% at 50° C. and a viscosity of less than 200 centipoises at 80° C., (e) heating the coating material to a temperature sufficiently above its melting temperature to melt the material, and (f) spraying the melted material onto the particles at an air atomization temperature which is preferably at least 5° C. above the melting temperature of the material for a time sufficient to form a continuous, coherent coating of a thickness of from 100 to 1,500 microns on the particles, preferably from 200 to 750 microns.

The amount of coating applied to the core particles is typically from about 20 to 90%, preferably about 40 to 60% and most preferably 40–50% by weight of the total particle (i.e., core plus coating).

Coating Process

There are several methods of processing the encapsulates of the invention. In a fluidized bed operation utilizing a top spray, air is introduced into the bed from below while the coating material is sprayed onto the fluidized material from above. The particles move randomly in the bed in this top spray operation.

An alternative method is the Wurster mode. In this method, the material is sprayed from the bottom of the bed concurrently with the air flow. The particles move in a well-defined flow pattern as is known in the art.

Unless precautions are taken in applying molten coating materials in fluidized beds, the resulting material can be poorly coated or, alternatively, agglomerated together. These equally undesirable results follow from the temperature settings in operating the fluidized bed. For example, when the temperature of the bed is too far below the melting point of the paraffin wax or paraffin wax blend, the material will quickly begin to solidify as soon as it enters the cool bed region. Thus, the coating blend loses some of its ability to adhere to the surface of the particles, and the material itself quickly solidifies. When this occurs, the fluidized bed is operating to produce fine coating particles with little coating on the core particles. The poorly coated core particles consequently have little stability from ambient humidity or an aqueous liquid environment. Alternatively, when the bed temperature is too high, the blend which does contact the particles fails to cool sufficiently and so remains soft and sticky. Consequently, particles clump and agglomerate. It becomes difficult to control the size of the resulting clumps. This can result in unacceptable properties for use in consumer products, such as dispensing problems. Additionally, agglomerates may easily break apart during handling to expose the core material to the environment. Thus, improper control of the fluidized bed temperatures can produce encapsulated bleach which fails to meet one of the objects of the invention.

Applicants have discovered that, even with the coatings of up to 1,500 micron thickness, proper control of the bed temperature and the atomization temperature in a fluidized bed avoids agglomeration. Thus, when the bed temperature is from 20° C. to no higher than the melting point of the material, "spray cooling" of the material and agglomeration of coated particles is reduced. Preferably, the bed temperature is 20° to 35° C. and most preferably 25° to 32° C.

Applicants have further discovered that atomization temperature, or the temperature at which the material is sprayed from a nozzle onto the fluidized bed, is advantageously held at least about 5° to 10° C. above the melting temperature of the blend. When the top spray mode is used, the maximum atomization temperature is about 35° C. greater than the wax melting point; above this temperature, too great a percentage of the particles agglomerate. When the Wurster mode is used to coat particles, the atomization temperature may be as high as 50° C. and more above the blend melting point temperature. This is found to be a practicable atomization temperature despite the expectation that partially coated particles with molten coats would stick to the spray nozzle. It is instead found that the air flow is strong enough to detach these partially coated particles. Alternatively, applicants have found that the temperature of the molten material may be maintained substantially above the material melting point, e.g., from 50° to 100° C. above the melting point. When this is the case, the atomization air temperature is preferably near the melting temperature of the blend, in order to lower the temperature of the atomized blend sufficiently to solidify quickly on the particles in the fluidized bed.

When using the top spray mode for encapsulation, applicants have discovered that performing an additional annealing step after coating the particles in a top spray fluidized bed further improves the capsules. "Annealing" is the name given to a further heating of wax-encapsulated bleach particles at a temperature greater than room temperature but below the wax melting point. This heating step is performed with the bed being fluidized, i.e., with warm air flowing through it; however, no molten material is being sprayed on to the particles during annealing. The annealing step renders the coating material mobile enough that it fills in gaps and cracks in its surface, thus providing a better seal to the bleach within.

The temperature chosen for annealing is one which softens the material without rendering it sticky. Typically, this temperature is from 5° to 15° C. greater than the bed temperature during coating, and from 3° to 15° C. less than the melting point of the coating material. For example, when the material has a melting point of 46° C., the annealing temperature may be about 33°–34° C. The bed temperature during spraying is only about 31°–32° C., for above 32° C. there is a good chance the particles will agglomerate i.e., the high temperature of the molten material, combined with coating material at the bed temperature, would so soften the material that particles would agglomerate in the fluidized bed. However, when no hot molten material is being sprayed on the particles, the annealing temperature alone in the bed is not sufficient heat to cause agglomeration.

Most preferably, annealing should be performed for a period of between 10 minutes and 48 hours, optimally between about 1 and 24 hours. Mixing the capsules with an inert material, such as an amorphous silica, alumina or clay, prevents capsule sticking during the annealing process. Incorporation of the inorganic annealing adjunct allows use of higher temperatures during the annealing process, thus shortening the annealing period. Adjuncts may be used in an amount relative to the weight of the overall capsule in the ratio of 1:200 to 1:20, preferably 1:100 to 1:30.

A preferred alternative to the top spray of molten coating material is the Wurster spray mode. This method is described in detail in U.S. Pat. No. 3,253,944, which is hereby incorporated by reference. In general, fluidized beds are characterized by randomness of particle motion. Random motion is undesirable when coating particles because of the resultant slow coating rates. To overcome this problem, a cyclic flow pattern is established in the Wurster spray mode by controlled velocity differences.

The Wurster mode involves use of a vertically disposed coating tower wherein particles are suspended in an upwardly flowing air stream entering the bottom of the tower. This air stream imparts controlled cyclic movement to the particles with a portion of the suspended bed flowing upwardly inside the tower and the other portion downwardly outside the tower. All of the coating material is directed into the high velocity air stream to provide coating of the particles moving upwardly in the tower. The fluid coating solidifies on the surface of the particles as the air stream lifts them away from the nozzle. The particles are carried to the top of the tower from which point they fall to the base of the tower along a path outside the tower. At the base, the particles are drawn in through openings and redirected upwardly in the air stream inside the tower. This cycle is repeated until the desired amount of coating has been deposited on the particles.

Given the steps of Wurster, it was believed that the Wurster mode would be inappropriate for encapsulating particles in material. Additionally, conventional wisdom taught that the relatively slow movement of particles in the Wurster bed would result in agglomeration.

Applicants surprisingly discovered that agglomeration in the Wurster mode is significantly lower then in the top spray mode. The spray nozzle for Wurster is located at the bottom of the fluidized bed and sprays coating materials upwards. It was believed this configuration of the spray nozzle would lead to clogging of the spray nozzle when coated and agglomerated particles fell from the upward air spray into the nozzle area. This risk seemed especially high because the nozzle temperature is generally above the melting point of the material coating. However, applicants have surprisingly discovered that use of the Wurster spray mode results in many benefits.

When operated under optimum conditions, upwards to 5–15% of the particles coated by top spray may agglomerate, and so be unusable, whereas the level of agglomerated particles from the Wurster application of a fluidized bed rarely exceeds 2% of the particles.

It is generally preferred to use a spray-on rate of from about 10 to about 40 g/min/kg. for economic processing and good product quality. However, it has been found advantageous to use lower rates of spraying from about 1 to 10 g/min/kg. at the commencement of each batch, when the uncoated particles are relatively fragile and small, before increasing the spray-on rate to a higher level, so as to shorten the processing time. However, the lower rates can be employed throughout the spray-on process if desired, or if only thin coatings are required for specific products.

Moreover, the coating time with the Wurster configuration can take half as long as top spray, or less, even with a substantially lower air flow rate, as demonstrated in Example I below. Although batch size is often smaller than in top spray, and the rate of spraying material onto the core from each nozzle is not substantially higher in the Wurster mode, still the production rate of the encapsulated particles may be as much as 2 to 3 times higher by the Wurster mode due to an increased number of nozzles possible in the unit. This higher production rate may be maintained even when the air flow rate through the fluidized bed is lower than for the top spray mode. Thus, higher production rates with lower air flow rates in the Wurster mode produce particles with less agglomeration than the top spray mode.

A further advantage discovered by applicants in using the Wurster spray mode is that no annealing step is needed. More accurately, self-annealing occurs automatically as part of the coating process when the Wurster mode is used. The hot molten material droplet contacting the partly coated bleach particle causes the solid wax already on the particle to melt and to fill any cracks in the coating surface. Unlike the spray-coated particles in top spray mode, which fall into a crowded mass of other particles in the fluidized bed, the particles in the Wurster mode move out of the spray tower and fall through the less crowded space outside the tower due to the well defined flow pattern of the particles in the Wurster mode. Thus, the particles have time to cool sufficiently before contacting other particles.

There are many commercially available fluid bed apparatuses which are suitable for use in the process of the invention; among these are the GPCG-5 and GPCG-6 models of Glatt Air Techniques of Ramsey, N.J. These two models can coat 8 to 225 kg loads of the particles in from 0.5 to 3 hours, respectively. Table top encapsulation may be carried out in laboratory scale apparatuses as well, as for example in Granuglatt Model No. WSG-3, ex Glatt Air Techniques.

High Shear Rotating Pan Coating

An alternative process to the top spray and bottom spray process to produce encapsulated particles for liquids is the high shear rotating pan coating unit. This apparatus combines the high shear bed movement with superior coating and cooling properties of a bottom spray fluid bed. Generally it comprises an inner and an outer process zone. The inner zone creates particle movement comparable to the movement produced by a high shear vertical granulator. The outer zone is a low particle density fluid bed region where the particles flow in a well defined pattern. This outer zone is comparable to the venturi tube region of a bottom spray fluid bed. In a preferred embodiment the zones are defined by an inner and outer chamber.

The bottom part of the inner zone is a rotary disc with a cone in the middle. The surface of the disc can be either smooth or textured. Air is introduced into the plenum beneath the rotary disc to prevent product from depositing between the disc and the wall and from penetrating into the lower part of the unit. The lower, stationary part of the wall separating the two zones has openings for one or more spray nozzles. The upper, movable part of the wall can be lifted to create an adjustable ring gap. This opening allows the product to pass into the outer fluidized bed region of the unit where the coating is cooled and hardened in a low density fluidized region. This outer annular chamber has a stationary perforated bottom plate through which cool air flows upwards to fluidize and cool the particles.

With ideal operating parameters the particles move past the coating nozzle where molten polyvinyl ether material is sprayed onto the particles. They then flow through the gap into the outer fluidized bed region of the unit and are carried upward in a distinct flow pattern over the wall in a low particle density region of the bed. This allows only minimal collision of the coated particles before cooling and hardening of the coating material occurs. The particles then fall back into the bed of particles which is rotating at high speed on top of the rotating disc. The rotation creates a substantially helical movement of the individual particles and a velocity gradient through the bed. This high speed movement of the particles minimizes their agglomeration. This is especially beneficial when the particles have a tacky surface as is the case when a warm coating of coating material is present.

Critical parameters must be used for the operation of the high shear rotating pan coater for the proper formation of nonagglomerated, encapsulated particles having a continuous coating. The most important parameters which must be controlled to obtain well coated particles for liquid products are the disc rotation speed, bed temperature, and coating spray rate.

The plate speed must be well controlled in order to achieve a continuous coating which will protect the core material when submersed in aqueous liquids containing surfactants. This speed is related to the momentum of the particles as they move past the spray nozzles. Smaller coating units and light particles will therefore require higher plate rotational speeds to impart the same momentum to the particles. When the momentum of the particles is too low, unacceptably high levels of agglomeration will occur and problems will arise from material sticking to various parts of the unit such as the center of the spinning disc. If the momentum of the particles is too high, the coating material will distribute quickly on the surface to form spherical beads. When the original core material is not spherical (which is the more general case) this will leave thin areas in the coating or even some of the core protruding through the coating. It is also possible that such high momentum will cause the coating to crack when the particles collide with each other or parts of the equipment. The result of these effects is to produce extremely poor encapsulates with low stability. Thus, the momentum of the particles on the plate surface at its periphery is preferably between 0.1 g.cm/sec and 15.0 g.cmsec and most preferably between 0.5 g.cm/sec and 5.0 g.cm/sec.

The temperature of the bed must also be well controlled to minimize the level of agglomeration that occurs. A result of the particles being in closer contact with one another is that the bed temperature must be lower than the bottom spray fluid bed described in the foregoing method in order to achieve the same coating quality, even when working with the same materials. This lowers agglomeration by promoting more rapid hardening of the material coating. The bed temperature is preferably 15° to 30° C. below the melting point of the material, most preferably 20° to 25° C. below the material's melting point. Higher bed temperatures will result in heavy agglomeration and poor coating which results from it along with defects resulting from protruding areas of the core. Lower temperatures result in the material hardening too quickly and not forming a continuous coating on the particles. To achieve this bed temperature the fluidizing air temperature and volume must be well controlled. The volume of fluidizing (cooling) air is also constrained and set by the bed size and the need to produce good fluidization of the particles. Good fluidization is defined here as moving all the particles in a uniform pattern without allowing any of them to become stagnated or form a dead spot in the bed.

Operating under these conditions, it has been found that coating rates of up to 30 g/min per kg of core are possible. This rate is dependent on the cooling capacity of the bed (fluidizing air temperature), temperature of the coating liquid, and particle momentum. Since the particles are much smaller at the beginning of the batch, it has been found that agglomeration is minimized by starting with coating rates of 10 g/min per kg core or lower and then increasing the coating rate as the particles grow. The temperature of the liquid polyvinyl ether blend prior to spraying is preferably 25° to 60° C. higher than its melting point. Higher temperatures cause agglomeration by raising the bed temperature and cause the problems previously discussed. Lower temperatures result in spray cooling the material and incomplete coatings.

The atomization air pressure is preferably between 3.0 and 5.0 bar. This causes the formation of small droplets which are required to minimize agglomeration. The nozzles are spraying into the bed of particles and the use of large droplets of molten material would result in excessive redistribution of the material between colliding particles which would ruin the crystal structure of the hardening material and increase the permeability of the coating. The atomization air temperature is preferably 5° to 50° C. above the material's melting point to ensure that the material leaving the nozzle tip has not already started to crystallize and harden before reaching the core particles. The slit air pressure between the plate and wall was seen to have very little effect on the encapsulate quality.

A distinct advantage of the high shear rotating pan coater process over the fluid bed type equipment is that a flow aid may be directly added to the bed of particles within the unit at the conclusion of the coating process. Normally flow aid materials are very low density powders which would be entrained and carried into the filters of top and bottom spray fluid beds. Only a small fraction of the added flow aid would be found on the particle surface. The high shear rotating pan coater apparatus has the capability of stopping the fluidization at the conclusion of the coating process and then operating the unit as a vertical granulator (i.e., rotating the coated particles in the inner zone). The flow aid may then be added and distributed through the bed homogeneously and with nearly complete recovery of the flow aid on the particles.

High shear rotating pan coater units are commercially supplied as Rotoprocessor® units by Niro-Aeromatic of Columbia, Md.

Another processor which may be adapted for the high shear rotating pan coater process is the Rotocoat® unit supplied by Sandvik Process Systems, Inc. of Totowa, N.J.

Agglomerating the Core Particles

As discussed above if the selected core material is not commercially available in an agglomerated form for use in the invention, there are several methods known in the art for producing such agglomerates. Such methods include softening or melting an agglomerating agent and contacting the softened or molten agglomerating agent with the selected core material in a pan granulator, a rolling drum, a fluid bed, or a falling curtain spray-on.

A preferred preparation technique for this equipment is "wet granulation" where a solution of the agglomerating agent is sprayed onto the active particles while drying the material to slowly build bridges of agglomerating agent between the active material and produce agglomerates of the preferred characteristics. In an optional preparation technique, the molten agglomerating agent having a melting temperature in the range from about 40° C. to 80° C. is sprayed onto the active core species in a pan granulator.

In another preferred preparation technique, the core particles may be prepared in a high-speed mixer/granulator. The agglomerating agent must be stable and inert with respect to the active materials, should not melt below 40° C., and must be completely soluble or dispersible in an alkaline solution or melt above 50° C. Suitable agglomerating agents and processing conditions are described in EP 0,390,287 corresponding to U.S. Ser. No. 07/495,548 filed on Mar. 19, 1990, and Ser. No. 07/604,030, herein incorporated by reference.

Another approach for production of the core particles is to disperse the active agent uniformly in the agglomerating agent. The mixture is heated so that it is in a soft or molten state so that the mixture becomes a uniform dough. This dough is then extruded with an axial or radial extruder to form noodles which are cut to form small pellets. The pellets are produced to have the characteristics specified above. In an optional additional step, these pellets may be spheronized by a treatment in a machine known as a Marumerizer® instrument distributed by Luwa Corporation of Charlotte, N.C. This spheronizing method is described in U.S. Pat. No. 4,009,113 herein incorporated by reference.

An additional approach is to spray the liquid active material, or a solution of the active material onto an inert base particle in a pan granulator, fluid bed, or rolling drum. In this approach the active agent is absorbed into the base particles, coated on the base particles, or used as an agglomerating agent for the base particles. Typical, but not exclusive, examples of inert base particles are the organic and inorganic water soluble builder and filler salts. This approach is particularly suited to production of many surfactant, peracid, and catalyst core particles.

Specific examples of agglomerating agents suitable for use with bleach or bleach activator components cited in this invention are disclosed in U.S. Pat. Nos. 4,087,369; 4,486,327, EP 0 376 360, U.S. Pat. Nos. 4,917,811, 4,713,079, 4,707,160, EP 0 320 219, U.S. Pat. No. 4,917,813, and Ser. No. 07/543,640, filed on Jun. 26, 1990 by Garcia et al. describing polymer protected bleach precursors herein incorporated by reference. The weight ratio of bleach to the agglomerating agent is normally in the range 1:2 to 25:1, preferably from 2:1 to 20: 1. The encapsulates formed from these agglomerated bleach or bleach activator core particles are normally dosed into the final product formulation at levels from 0.5% to 25%, preferably from 2% to 15%.

A typical catalyst included in core particles is a manganese (II) salt. An example of agglomerating agents and processing methods suitable for production of catalyst core particles cited in this invention are disclosed in U.S. Pat. No. 4,711,748, herein incorporated by reference. This patent teaches adsorbing manganese (11) salts onto an aluminosilicate support and wet granulation with various binders to form granules in the proper size range. The weight ratio of catalyst to the support material and agglomerating agent is normally in the range 1:10 to 1:200,000. The encapsulates formed from these agglomerated catalyst core particles are normally dosed into the final product formulation at levels from 0.001% to 5%.

Cleaning Compositions Incorporating Encapsulated Particles

The encapsulated particles of the invention may be incorporated into a variety of powder and liquid cleaning compositions, such as automatic machine dishwashing, hard surface cleaners and fabric washing cleaners for both household and industrial use. Most of these compositions will contain from about 1–75% of a builder component and will also contain from about 0 to about 40% of a surfactant, preferably about 0.5% to about 20% by weight of the composition.

The surfactant may be encapsulated according to the invention to prevent mutual degradation with a bleaching agent which is not coated in the formula. The encapsulated surfactant would be present in an amount of 0.1 to 5% by weight of the composition.

Other ingredients which may be present in the cleaning composition include cleaning enzymes, peracid precursors or bleach catalysts. Any one or more of these ingredients may also be encapsulated before adding them to the composition. If such ingredients are encapsulated they would be present in the following percentages by weight of the composition:

| | |
|---|---|
| enzyme | 0.1 to 5% |
| peracid precursor | 0.1 to 10% |
| bleach catalyst | 0.001 to 5% |
| peracid | 0.1 to 10% |

Automatic dishwashing detergent powders and liquids will usually have the compositions listed in Table I.

TABLE I

Automatic Dishwashing Detergent Compositions

| COMPONENTS | PERCENT BY WEIGHT POWDER FORMULATION | PERCENT BY WEIGHT LIQUID FORMULATION |
|---|---|---|
| Builder | 0–70 | 0–60 |
| Surfactant | 0–10 | 0–15 |
| Filler | 0–60 | — |
| Alkalinity Agent | 0.1–40 | 0.1–30 |
| Silicate | 0–40 | 0–30 |
| Bleaching Agent | 0–20 | 0–20 |
| Enzymes | 0–5 | 0–5 |
| Enzyme Stabilizing System | — | 0–15 |
| Antifoam | 0–2 | 0–2 |
| Bleaching Catalyst | 0–5 | 0–5 |
| Thickener | — | 0–5 |
| Bleach Scavenger | 0–5 | 0–5 |
| Perfume | 0–2 | 0–2 |
| Water | to 100 | to 100 |

Gels differ from liquids in that gels are primarily structured by polymeric materials and contain little or no clay.

Detergent Builder Materials

The cleaning compositions of this invention can contain all manner of detergent builders commonly taught for use in automatic dishwashing or other cleaning compositions. The builders can include any of the conventional inorganic and organic water-soluble builder salts, or mixtures thereof and may comprise 1 to 90%, and preferably, from about 5 to about 70% by weight of the cleaning composition.

Typical examples of phosphorus-containing inorganic builders, when present, include the water-soluble salts, especially alkali metal pyrophosphates, orthophosphates and polyphosphates. Specific examples of inorganic phosphate builders include sodium and potassium tripolyphosphates, phosphates, pyrophosphates and hexametaphosphates.

Suitable examples of non-phosphorus-containing inorganic builders, when present, include water-soluble alkali metal carbonates, bicarbonates, sesquicarbonates, borates, silicates, layered silicates, metasilicates, and crystalline and amorphous aluminosilicates. Specific examples include sodium carbonate (with or without calcite seeds), potassium carbonate, sodium and potassium bicarbonates, silicates and zeolites.

Particularly preferred inorganic builders can be selected from the group consisting of sodium tripolyphosphate, potassium pyrophosphate, sodium carbonate, potassium carbonate, sodium bicarbonate, sodium silicate and mixtures thereof. When present in these compositions, sodium tripolyphosphate concentrations will range from about 2% to about 40%; preferably from about 5% to about 30%. Sodium carbonate and bicarbonate when present can range from about 5% to about 50%; preferably from about 10% to about 30% by weight of the cleaning compositions. Sodium tripolyphosphate and potassium pyrophosphate are preferred builders in gel formulations, where they may be used at from about 3% to about 30%, preferably from about 10% to about 20%.

Organic detergent builders can also be used in the present invention. Examples of organic builders include alkali metal citrates, succinates, malonates, fatty acid sulfonates, fatty acid carboxylates, nitrilotriacetates, phytates, phosphonates, alkanehydroxyphosphonates, oxydisuccinates, alkyl and alkenyl disuccinates, oxydiacetates, carboxymethyloxy succinates, ethylenediamine tetracetates, tartrate monosuccinates, tartrate disuccinates, tartrate monoacetates, tartrate diacetates, oxidized starches, oxidized heteropolymeric polysaccharides, polyhydroxysulfonates, polycarboxylates such as polyacrylates, polymaleates, polyacetates, polyhydroxyacrylates, polyacrylate/polymaleate and polyacrylate/polymethacrylate copolymers, aminopolycarboxylates and polyacetal carboxylates such as those described in U.S. Pat. Nos. 4,144,226 and 4,146,495.

Alkali metal citrates, oxydisuccinates, polyphosphonates and acrylate/maleate copolymers are especially preferred organic builders. When present they are preferably available from about 1% to about 35% of the total weight of the detergent compositions.

The foregoing detergent builders are meant to illustrate but not limit the types of builder that can be employed in the present invention.

Surfactants

Surfactants may be preferably included in the household cleaning product incorporating the encapsulated particles. Such surfactants may be encapsulated or not for inclusion in the composition. Useful surfactants include anionic, nonionic, cationic, amphoteric, zwitterionic types and mixtures of these surface active agents. Such surfactants are well known in the detergent art and are described at length in "Surface Active Agents and Detergents", Vol. II, by Schwartz, Perry & Birch, Interscience Publishers, Inc. 1959, herein incorporated by reference.

After the capsule has melted, it remains molten or resolidifies depending on the temperature of the washing medium. Whether in molten or solid state, however, the coating mixture may deposit on the surface of pieces being washed as a soil and impart a spotted, streaked or filmy appearance to those pieces. Such soil may also build up on the surfaces in which cleaning is being performed or in cleaning machines.

This soiling by the coating may be reduced by incorporating one or more surfactants in the cleaning composition.

Thus, a preferred embodiment of the cleaning composition comprises 0.1% to 15% by weight encapsulated bleach as described above; 1% to 75% builder; and 0.1% to 15% surfactant selected from the group consisting of nonionic surfactants, including those of formula $$R-(\underset{\underset{R^1}{|}}{CH_2CHO})_x(CH_2CH_2O)_y(\underset{\underset{R^2}{|}}{CH_2CHO})_zH \qquad \text{(II)}$$

where R is a $C_6$–$C_{10}$ linear alkyl mixture, $R^1$ and $R^2$ are methyl, x averages 3, y averages 12 and z averages 16, polyoxyethylene or mixed polyoxyethylene/polyoxypropylene condensates of aliphatic alcohols containing 6–18 carbon atoms and 2–30 alkylene oxide.

Silicate

The compositions of this invention may contain sodium or potassium silicate at a level of from about 1% to about 40%, preferably 1% to 20% by weight of the cleaning composition. This material is employed as a cleaning ingredient, source of alkalinity, metal corrosion inhibitor and protector of glaze on china tableware. Especially effective is sodium silicate having a ratio of $SiO_2$:$Na_2O$ of from about 1.0 to about 3.3, preferably from about 2 to about 3.2. Some of the silicate may be in solid form.

Filler

An inert particulate filler material which is water-soluble may also be present in cleaning compositions in powder form as described in Lang, U.S. Pat. No. 5,200,236.

Thickeners and Stabilizers

Thickeners are often desirable for liquid cleaning compositions. Thixotropic thickeners such as smectite clays including montmorillonite (bentonite), hectorite, saponite, and the like may be used to impart viscosity to liquid cleaning compositions. Silica, silica gel, and aluminosilicate may also be used as thickeners. Salts of polyacrylic acid (of molecular weight of from about 300,000 up to 6 million and higher), including polymers which are cross-linked may also be used alone or in combination with other thickeners. Use of clay thickeners for automatic dishwashing compositions is disclosed for example in U.S. Pat. Nos. 4,431,559; 4,511,487; 4,740,327; 4,752,409. Commercially available bentonite clays include Korthix H and VWH ex Combustion Engineering, Inc.; Polargel T ex American Colloid Co.; and Gelwhite clays (particularly Gelwhite GP and H) ex English China Clay Co. Polargel T is preferred as imparting a more intense white appearance to the composition than other clays. The amount of clay thickener employed in the compositions is from 0.1 to about 10%, preferably 0.5 to 5%. Use of salts of polymeric carboxylic acids is disclosed for example in UK Patent Application GB 2,164,350A, U.S. Pat. Nos. 4,859,358 and 4,836,948.

For liquid formulations with a "gel" appearance and rheology, particularly if a clear gel is desired, a bleach stable polymeric thickener is particularly useful. U.S. Pat. No. 4,260,528 discloses natural gums and resins for use in clear autodish detergents, which are not bleach stable. Acrylic acid polymers that are cross-linked manufactured by, for example, B. F. Goodrich and sold under the trade name "Carbopol" have been found to be effective for production of clear gels, and Carbopol 940 and 617, having a molecular weight of about 4,000,000 are particularly preferred for maintaining high viscosity with excellent bleach stability over extended periods. Further suitable bleach-stable polymeric thickeners are described in U.S. Pat. No. 4,867,896 incorporated by reference herein.

The amount of thickener employed in the compositions is from 0% to 5%, preferably 0.5% to 3%.

Defoamer

Liquid and "gel" formulations of the cleaning composition comprising surfactant may further include a defoamer. Suitable defoamers include mono- and distearyl acid phosphate, silicone oil and mineral oil. Even if the cleaning composition has only defoaming surfactant, the defoamer assists to minimize foam which food soils can generate. The compositions may include 0.02% to 2% by weight of defoamer, or preferably 0.05% to 1.0%.

Minor amounts of various other components may be present in the cleaning composition. These include bleach scavengers including but not limited to sodium bisulfite, sodium perborate, reducing sugars, and short chain alcohols; solvents and hydrotropes such as ethanol, isopropanol and xylene sulfonates; flow control agents (in granular forms); enzyme stabilizing agents such as borate, glycol, propanedial, formate and calcium; soil suspending agents; antiredeposition agents; anti-tarnish agents; anti-corrosion agents; colorants and other functional additives; and perfume. The pH of the cleaning composition may be adjusted by addition of strong acid or base. Such alkalinity or buffering agents include sodium carbonate.

EXAMPLES

The following examples will more fully illustrate the embodiments of the invention. All parts, percentages and proportions referred to herein and in the claims are by weight unless otherwise indicated.

EXAMPLE 1

A wet cake of 69.5% phthalimidoperhexanoic acid (PAP) having an average moisture content of 21.5% was granulated with 10% of a partially neutralized acrylate-maleate copolymer (Sokalan CP-45® supplied by BASF), 19.5% boric acid powder and 0.5% of a sodium salt of a secondary alkanesulfonate (Hostapur SAS-60® supplied by Hoechst Celanese) as a 60% aqueous solution. The average temperature of the granulation mixture was 17° C. The resultant granules were dried at 55° C. and then sieved to obtain a relatively high yield of the desired particle cut size of 840 microns to 2000 microns.

EXAMPLE 2

The granules prepared according to Example 1 were encapsulated in a 50% coating of a paraffin wax (Boler 1397® supplied by Boler of Wayne, Pa.) and 1% hydrogenated methyl ester of rosin supplied as Hercolyn D® by Hercules, Inc. One Batch A of encapsulates was prepared using the fluidized bed under the following conditions.

TABLE 1

| | |
|---|---|
| Spray Mode | Worster |
| Unit | Glatt GPCG-5 |
| Partition Height | 1.0 inch |
| Nozzle Tip Diameter | 1.2 mm |
| Nozzles | 1 |
| Volume | 10.5 liters |
| Bed Weight | 17.5 lbs |
| Air Flow Rate | 200–270 cfm |
| Inlet Air Temperature | 18–24° C. |
| Bed Temperature | 30–31° C. |
| Coating Rate | 72 g/min. |
| Coating Temperature | 75–80° C. |
| Atomization Air Pressure | 1.5 Bar |
| Atomization Air Temperature | 80–90° C. |
| Batch Time | 70 minutes |

A second Batch B of granules was encapsulated in the paraffin wax and hydrogenated methyl ester of rosin coating using the high shear rotating pan process in an Aeromatic MP-1 Rotoprocessor® apparatus supplied by Aeromatic of Columbia, Md., under the following conditions:

TABLE 2

| | |
|---|---|
| Spray Mode | Rotoprocessor ® |
| Unit | Aeromatic MP-2 |
| Partition Height | 24 mm |
| Nozzle Tip Diameter | 1.2 mm |
| Core Particle Charge | 12.0 kg |
| Air Flow Rate | 1250–1400 $m^3$/hr |
| Inlet Air Temperature | 15–20° C. |
| Bed Temperature | 18–22° C. |

TABLE 2-continued

| | |
|---|---|
| Coating Rate | 250 g/min |
| Slit Pressure | 2.5 Bar |
| Atomization Air Temperature | 75° C. |
| Plate Rotation Speed | 200–300 rpm |
| Atomization Air Pressure | 3.5 Bar |
| Wax Temperature | 70–85° C. |
| Nozzles | 3 |
| Batch Time | 48 minutes |

The resulting particles were evaluated with the following results.

TABLE 3

| | Batch A | Batch B |
|---|---|---|
| 1. Availability Oxygen, % | 3.97 | 4.10 |
| 2. Frangibility, % | 5.77 | 6.05 |
| 3. Ave. Particle Size, microns | 1120 | 1220 |
| 4. Moisture Content, % | 0.50 | 0.63 |
| 5. Dissolution Rate: | | |
| a. 2-min. dissolution, %, @ 50° C. per insoluble measurement method | 93.80 | 69.60 |
| b. T90 @ 50° C., minutes | 4.50 | ~25 minutes |

The dissolution rate was determined by the Insoluble Measurement Method. The results indicate that more than 70% of the particles dissolve during a two-minute period at 50° C. Batch A exhibited an even higher dissolution rate of almost 94% during the desired period. The high rate of oxygen agent dissolution was confirmed by a T90 measurement using an HPLC method.

Insoluble Measurement Method

The procedure for this method is as follows:

Preweigh the 120 mesh screen. Fill a 1000 ml beaker with 500 ml of milli-Q water, adjust to pH=10 with NaOH, and heat to 60° C. Agitate solution with magnetic stir bar so that vortex is 150 ml deep (measured with graduation on side of beaker). Add the granules and let mix for 2 minutes. Pour contents of beaker through the preweighed screen. Rinse baker with a minimum of ambient milli-Qs water to remove residual solids and pour over screen. Oven dry screen to constant weight (typically 4 hours at 105° C.). Allow screen to cool in a dessicator and reweigh screen. The results are calculated as follows:

$$\% \text{ insoluboles}=W_f-W_t/W_s\times 100$$

where $W_f$=final weight of screen $W_t$=initial weight of screen $W_s$=weight of sample

EXAMPLE 3

Various levels of surfactant were incorporated into granules containing 69.5% PAP according to the procedures described in Example 2 (Batch 1) and Example 3 (Batches 2–5). The surfactant used was a sodium salt of secondary alkane sulfonate supplied as 60% solution under the series Hostapur SAS-60® in amounts varying from 0% to 1%. The dissolution rates of the particles of the resulting batches were measured by means of the insoluble measurement method and the absorbance via spectrophotometry method with the following results.

TABLE 4

| Batch | Surfactant %[1] | Frangibility % | Yield % 840–2000 microns | Dissolution Rate @ 50° C. % Insoluble[2] | Dissolution Rate @ 50° C. T90, minutes |
|---|---|---|---|---|---|
| 1 | 0 | 6.05 | 50.50 | 30.40 | No Data |
| 2 | 0 | 7.40 | 57.60 | No Data | 25.00 |
| 3 | 1.00 | 11.15 | 57.70 | 4.90 | 4.70 |
| 4 | 0.50 | 5.77 | 57.50 | 6.20 | 4.50 |
| 5 | 0.25 | 4.58 | 51.30 | 11.90 | 7.50 |

[1]Sodium salt of secondary alkane sulfonate supplied as Hostapur SAS-60 by Hoescht Celanese as a 60% aqueous solution.

[2]Results when using the Insoluble Measurement Method of determining dissolution rate.

TABLE 5

| Batch # | Dissolution Rate of Oxygen Granules % Dissolution 1 min. | 2 min. | 3 min. | 4 min. | 5 min. | 8 min. |
|---|---|---|---|---|---|---|
| 1 - 0% | 13 | 30 | 35 | 42 | 48 | 62 |
| 2 - 0% | 13 | 30 | 35 | 42 | 48 | 62 |
| 3 - 0.25% | 43 | 78 | 80 | 84 | 90 | 91 |
| 4 - 0.5% | 42 | 80 | 83 | 87 | 92 | 93 |
| 5 - 1.0% | 50 | 82 | 84 | 87 | 93 | 93 |

From the foregoing Tables, it is noted that the addition of as little as 0.25% surfactant in the encapsulated oxygen particles increases the 2 minute dissolution rate of the encapsulates from about 30% to 77% dissolution. The addition of 0.5% to 1% surfactant increases the 2 minute dissolution rate to at least 80%. Thus, a relatively low level of surfactant added to the oxygen granule substantially improves the dissolution rate of the encapsulates with minimal effect on attrition resistance for yield.

EXAMPLE 4

The granules of Batches 1–5 of Example 3 above were stored for 12 weeks to determine their stability. Each batch was stored at 40° C. in a closed jar and room temperature in an open jar.

The capsules were then measured for available oxygen and it was determined that in all the batches the remaining available oxygen was over 95%. Thus, the addition of up to at least 1% surfactant in the encapsulates does not affect their long-term storage stability.

EXAMPLE 5

The effect of a surfactant in improving the release of the bleaching agent from within the molten coating material was tested with BC-1 bleaching experiments carried out in a tergotometer.

The bleaching performance of the o-carboxybenzamidoperoxyhexanoic acid and the manganese complex catalyst compositions of the present invention at a pH range of from 7 to 10 was evaluated against BC-1 test cloths. The BC-1 cloths were washed in tergotometer for 30 minutes at 55° C. in a 1000 ml aqueous wash solution. The dosage of the peracid compound was 20 ppm active oxygen. Stain bleaching was measured reflectometrically using a Colorgard/05 System Reflectometer.

Bleaching was indicated by an increase in reflectance, reported as ΔΔR, in general a ΔΔR of one unit is perceivable in a paired comparison while ΔΔR of two units is perceivable monadically. In reporting the reflectance change, the change in reflectance caused by general detergency has been accounted for. Thus ΔΔR can actually be expressed as:

$$\Delta\Delta R = \Delta R \text{ peracid+detergent} - \text{a } \Delta \text{ detergent}$$

where ΔR is the reflectance difference of the stained fabric after and before washing.

The following five systems outlined in Table 6 were investigated simultaneously.

TABLE 6

| | Automatic Dishwashing formulation | PAP Encapsulates With and Without Secondary Alkane Sulfonate (SAS) | | Granules (without encapsulation) | |
|---|---|---|---|---|---|
| Samples | Base[1] | − SAS | + SAS | − SAS | + SAS |
| 1 | Yes | — | — | — | — |
| 2 | Yes | Yes | — | — | — |
| 3 | Yes | — | Yes | — | — |
| 4 | Yes | — | — | Yes | — |
| 5 | Yes | — | — | — | Yes |

The automatic dishwashing formulation used a base containing:

Base Formulation

| | |
|---|---|
| Water | to 100% |
| Carbopol 627[1] | 1.5 |
| Na Citrate.$2H_2O$ | 30.0 |
| Glycerol | 6.0 |
| Borax | 3.0 |
| NaOH (50/50) | 0.8 |
| CP-7 (40%)[2] | 5.0 |
| Sulfite | 0.1 |
| Nonionic surfactant | 2.0 |
| Bleach capsules | 4.3 |
| Enzyme | 0.8 |

[1]An acrylic acid polymer ~4,000,000 supplied by B. F. Goodrich
[2]Polymeic cobuilder supplied by BASF A temperature ramp to simulate a heat-up cycle was achieved by setting the water temperature in a "bath" to 55° C. Then, at the start of the experiment, water at a temperature of 25° C. was added to each of five terge pots containing Samples 1–5. Two different timings were followed. These are described below along with the results obtained in each case.

Experiment A

The timings used in this experiment are summarized in Table 7 below.

TABLE 7

| Sample | t = 0 | t = 2 min | T = 45° C. t' = 0 | t' = 5 min |
|---|---|---|---|---|
| 1 | Base | BC-1 | | Cloths Removed |
| 2 | Base | BC-1 + Capsules | | |
| 3 | Base | BC-1 + Capsules | | |
| 4 | Base | BC-1 | + Granules | |
| 5 | Base | BC-1 | + Granules | |

The automatic dishwashing formulation (8.13 g/l) was dosed into the water immediately. After two minutes the BC-1 cloths were added to each of the terge pots. The wax encapsulates were also added to Samples 2 and 3 at this time. The temperature in the terge pots was monitored until the temperature reached 45° C. (t'=0). Then the PAP granules were dosed into Samples 4 and 5. The terge run was continued for 5 minutes (t'=5 min) after this point and then the cloths were removed, rinsed in cold water, and dried. The results of this experiment are given in Table 8 below.

TABLE 8

BC-1 Bleaching from Granular and Wax-Encapsulated Forms of PAP

| Sample | Encapsulates and Secondary Alkane Sulfonate | $R_{initial}$ | $R_{Final}$ | DR | DDR |
|---|---|---|---|---|---|
| 1 | None | 46.8 | 50.2 | 3.4 | 0 |
| 2 | Capsule − SAS | 47.6 | 60.3 | 12.7 | 9.3 |
| 3 | Capsule + SAS | 46.3 | 62.8 | 16.5 | 13.1 |
| 4 | Granule − SAS | 47.3 | 64.2 | 16.9 | 13.5 |
| 5 | Granule + SAS | 46.5 | 64.1 | 17.6 | 14.2 |

The results in Table 8 show that there is only a small difference in the level of bleaching obtained from the two granular forms of PAP (13.5 units compared to 14.2 units with surfactant). However, for the wax-encapsulates, a significant difference in the level of bleaching is found (9.3 units compared to 13.1 units when SAS is present in the granule). Furthermore, under these conditions we observed almost the same level of bleaching from Sample 3 capsules that was obtained from the Sample 5 granules (13.1 vs. 14.2), but that for the Samples 2 and 4 series without surfactant, the granules gave significantly better bleaching than the capsules (13.5 vs. 9.3). This is consistent with a longer delay in PAP getting out of the wax capsule and into solution when there is no surfactant in the granule to aid in its release. Thus, the surfactant significantly aids in the dispersion of the molten wax coating promoting more rapid dissolution of the bleaching core during washing. The release and dissolution rates of PAP from the encapsulates are comparable to the release and dissolution rates of uncoated PAP granules.

We claim:

1. A wax-encapsulated core material particle for use in liquid cleaning compositions, the encapsulated particles comprising:

(a) 10% to 80% by wt. of a core particle or an aggregate of core particles which are water soluble or water dispersible, or which dissolve, disperse or melt in a temperature range of from about 40° C. to about 50° C., the particle or particles comprising:

i) a bleaching compound selected from a group consisting of an organic peroxy acid, a diacyl peroxide, an inorganic peroxygen compound, a bleach catalyst, a peroxygen bleach precursor and mixtures thereof, and ii) 0.01% to about 5% of a surfactant; and (b) 20% to 90% by weight of a continuous coherent waxy coating, the coating comprising one or more paraffin waxes wherein the coating mixtures has a melting point of from about 40° C. to about 50° C., a solids content of from about 35% to 100% at 40° C. and a solids content of from 0% to about 15% at 50° C., and being from 100 to 1500 microns thick, the surfactant in the encapsulated particle substantially aiding in the dispersion of the coherent waxy coating to promote more rapid dissolution of the bleaching compound.

2. The encapsulated particle according to claim 1 wherein the core material is selected from a group consisting of an organic peroxy acid, a diacyl peroxide, an inorganic peroxygen compound, a peroxygen bleach precursor and mixtures thereof.

3. The encapsulated particle according to claim 2 wherein the organic peroxy acid is a monoperoxy acid.

4. The encapsulated particle according to claim 3 wherein the monoperoxy acid is an aliphatic and substituted aliphatic monoperoxy acid.

5. The encapsulated particle according to claim 1 wherein the surfactant is present in an amount of 0.1% to about 1%.

6. The encapsulated particle according to claim 1 wherein the surfactant is selected from a group consisting of anionic, nonionic, cationic and zwitterionic surfactants.

7. The encapsulated particle according to claim 6 wherein the anionic surfactant is selected from a group consisting of secondary sodium n-alkane sulphonates, sodium lauryl sulphate, potassium dodecyl sulphonate, sodium dodecyl benzene sulphonate, sodium salt of lauryl polyoxyethylene sulphate, lauryl polyethylene oxide sulfonate, dioctyl ester of sodium sulphosuccinic acid and sodium lauryl sulphonate.

8. A liquid cleaning composition comprising:

(a) 0.1% to 20% by wt. of the composition of an encapsulated core material in the form of particles having i) 10% to 80% by weight of a core particle or an aggregate of core particles which are water soluble or water dispersible, or which dissolve, disperse or melt in a temperature range of from about 40° C. to about 50° C., the particle or particles comprising:

1) a compound selected from a group consisting of an organic peroxy acid, a diacyl peroxide, an inorganic peroxygen compound, a bleach catalyst, a peroxygen bleach precursor and mixtures thereof and 2) 0.1% to about 5% of a surfactant; and ii) 20% to 90% by weight of a continuous coherent waxy coating the coating comprising one or more paraffin waxes wherein the coating mixture has a melting point of from about 40° C. to about 50° C., a solids content of from about 35% to 100% at 40° C. and a solids content of from 0% to about 15% at 50° C., and being from 100 to 1500 microns thick, the surfactant in the encapsulated particle substantially aiding in the dispersion of the coherent waxy coating to promote more rapid dissolution of the bleaching compound, b) 1% to 70% by weight of a builder; and c) water.

9. The composition according to claim 8 wherein the core material selected from a group consisting of an organic peroxy acid, a diacyl peroxide, an inorganic peroxygen compound, a peroxygen bleach precursor and mixtures thereof.

10. The composition according to claim 9 wherein the organic peroxy acid is a monoperoxy acid.

11. The composition according to claim 10 wherein the monoperoxy acid is an aliphatic and substituted aliphatic monoperoxy acid.

12. The composition according to claim 8 wherein the surfactant is present in an amount of 0.1% to about 1%.

13. The composition according to claim 12 wherein the surfactant is selected from a group consisting of anionic, nonionic, cationic and zwitterionic surfactants.

14. The composition according to claim 13 wherein the anionic surfactant is selected from a group consisting of secondary sodium n-alkane sulphonates, sodium lauryl sulphate, potassium dodecyl sulphonate, sodium dodecyl benzene sulphonate, sodium salt of lauryl polyoxyethylene sulphate, lauryl polyethylene oxide sulfonate, dioctyl ester of sodium sulphosuccinic acid and sodium lauryl sulphonate.

* * * * *